US011224791B2

(12) United States Patent
Lodwick

(10) Patent No.: US 11,224,791 B2
(45) Date of Patent: Jan. 18, 2022

(54) OVERHANG CLIMB STRENGTH TRAINER

(71) Applicant: Brian Edward Lodwick, Westerville, OH (US)

(72) Inventor: Brian Edward Lodwick, Westerville, OH (US)

( * ) Notice: Subject to any disclaimer, the term of this patent is extended or adjusted under 35 U.S.C. 154(b) by 0 days.

(21) Appl. No.: 15/930,942

(22) Filed: May 13, 2020

(65) Prior Publication Data

US 2021/0283477 A1 Sep. 16, 2021

Related U.S. Application Data

(60) Provisional application No. 62/848,811, filed on May 16, 2019.

(51) Int. Cl.

| | |
|---|---|
| ***A63B 69/00*** | (2006.01) |
| ***A63B 22/00*** | (2006.01) |
| ***A63B 21/04*** | (2006.01) |
| ***A63B 21/00*** | (2006.01) |
| *A63B 23/12* | (2006.01) |

(52) U.S. Cl.

CPC ..... *A63B 69/0048* (2013.01); *A63B 21/0428* (2013.01); *A63B 21/4045* (2015.10); *A63B 22/001* (2013.01); *A63B 22/0061* (2013.01); *A63B 23/1209* (2013.01)

(58) Field of Classification Search

CPC . A63B 21/0428; A63B 21/0445; A63B 21/15; A63B 21/11; A63B 21/153; A63B 21/154; A63B 21/4019; A63B 21/4028; A63B 22/001; A63B 69/0048; A63B 9/00; A63B 2009/002; A63B 2009/004; A63B 2009/006; A63B 2009/008; A63B 23/035; A63B 23/03508; A63B 23/03516; A63B 23/03525; A63B 23/03533; A63B 23/03541; A63B 23/0355; A63B 23/12; A63B 23/1209; A63B 23/1218; A63B 23/1245; A63B 23/1254; A63B 23/1263; A63B 23/1272; A63B 23/1281; A63B 23/14; A63B 23/16

See application file for complete search history.

(56) References Cited

U.S. PATENT DOCUMENTS

| | | | | |
|---|---|---|---|---|
| 5,040,785 | A | 8/1991 | Charnitski | |
| 5,125,877 | A | 6/1992 | Brewer | |
| 6,860,836 | B1 * | 3/2005 | Wu | A63B 22/001 198/850 |
| 9,132,330 | B2 * | 9/2015 | Brendle | A63B 21/169 |
| 9,302,138 | B2 * | 4/2016 | McCanney | A63B 21/4035 |
| 10,232,243 | B2 * | 3/2019 | Bowers | A63B 69/0064 |
| 10,758,803 | B2 * | 9/2020 | Morse | A63B 69/0048 |

(Continued)

*Primary Examiner* — Megan Anderson

(57) ABSTRACT

An overhead climb strength trainer apparatus comprises a frame bisected by at least one vertical frame portion, forming first and second climbing areas. First and second climbing panels are slideably mounted within the respective climbing areas and each include climbing holds and a panel hook. A line connects the first and second panel hooks, running through line guides and around a friction cylinder. The frame is configured for mounting at a predetermined angle of inversion for simulating an overhead climb as users manually raise and lower the first and second climbing panels in a reciprocating fashion within the first and second climbing areas respectively.

17 Claims, 14 Drawing Sheets

(56) References Cited

U.S. PATENT DOCUMENTS

| | | | | |
|---|---|---|---|---|
| 2002/0169052 | A1* | 11/2002 | Godsey | A63B 69/0048<br>482/37 |
| 2020/0222778 | A1* | 7/2020 | Smith | A63B 71/023 |
| 2021/0101061 | A1* | 4/2021 | Pell | A63B 69/0048 |

* cited by examiner

OVERHANG CLIMB STRENGTH TRAINER

CROSS-REFERENCE TO RELATED APPLICATION

This Non-Provisional Patent Application claims priority to and claims the benefit of United States Provisional Patent Application Ser. No. 62/848,811, entitled "Overhang Climb Strength Trainer," filed May 16, 2019, which is incorporated by reference in its entirety as if fully set forth herein.

TECHNICAL FIELD

The apparatuses and methods disclosed in this document pertain generally to the field of exercise equipment. More specifically, the disclosed apparatuses and methods pertain to the strength training for rock climbing.

BACKGROUND

Figure 1:
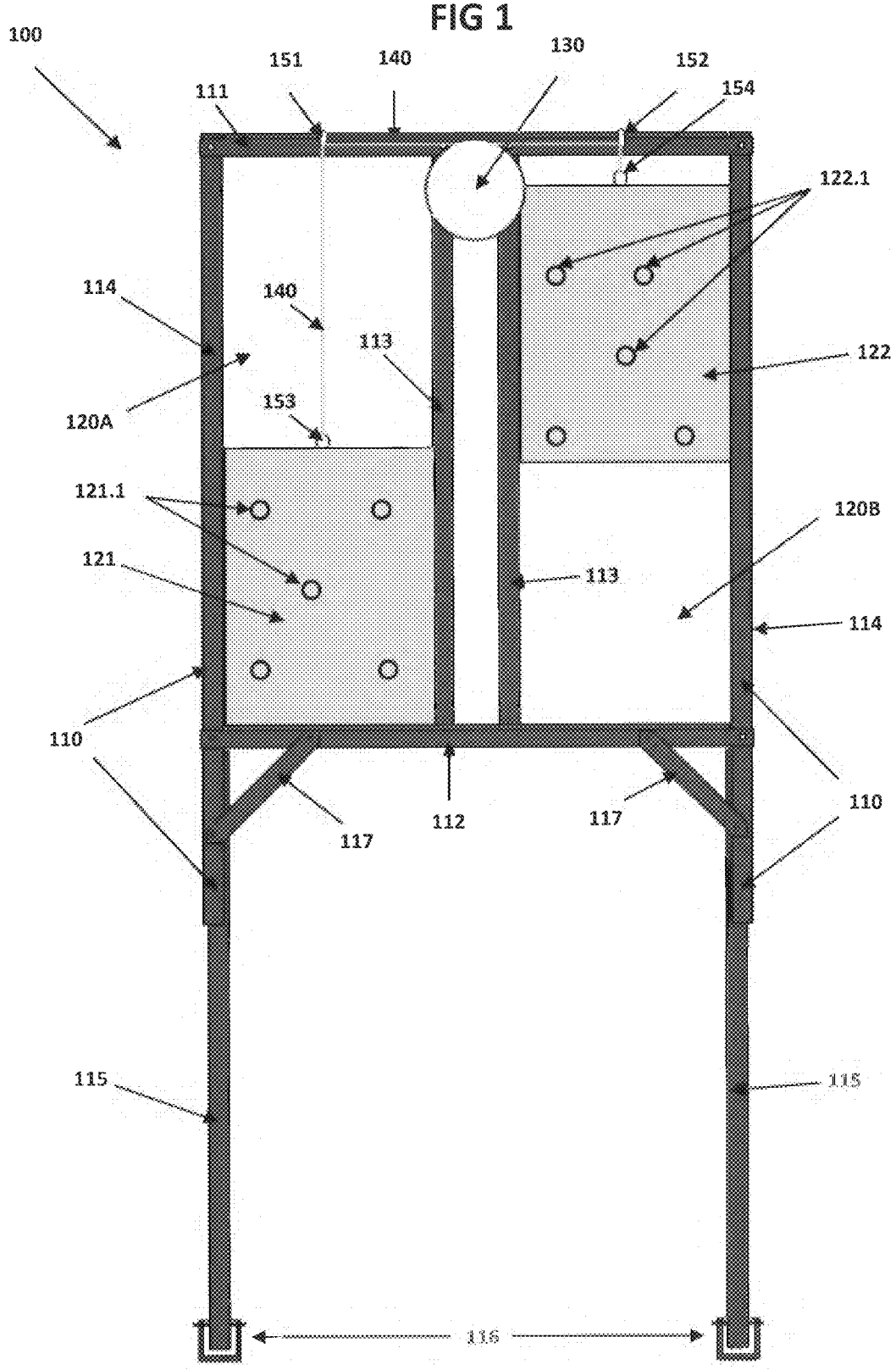
FIG. 1 is a frontal view of an overhang climb strength trainer 100.

Rock climbing is a popular sport and a physically demanding form of exercise. In particular, climbing overhanging rock formations that require the climber to grip the rock and extend his body past vertical in some degree of inversion can be especially difficult and physically demanding.

Outdoor rock climbing requires a significant investment by the participant in skills development, physical fitness, equipment, and time. Additionally, in an ideal scenario, a rock climber will have one or more fellow climbers assisting to improve safety, such as, for example, a belayer to manage a climbing rope to catch the climber in the event of a fall.

Simulated rock climbing, also known as "indoor rock climbing," facilities provide a more convenient and accessible means for rock climbing enthusiasts to develop their skills and physical fitness. Existing facilities typically utilize large, often multi-story, vertical climbing areas with climbing holds to simulate a natural climbing rock. Such facilities use either or both manual or automatic belaying devices for the safety of climbers. Such indoor rock climbing facilities have the disadvantage of requiring a large investment to build, maintain, and properly staff and require a large physical space.

For climbers who are specifically interested in the strength training and physical fitness aspects of climbing, relatively smaller and less expensive simulated climbing walls have been developed for home or gym use. For example, Brewer (U.S. Pat. No. 5,125,877) discloses a "Simulated Climbing Wall" with rotating climbing panels in a continuous chain akin to a vertical treadmill for rock climbing. Though less so than a full indoor climbing gym, Brewer still has the drawbacks of being relatively complicated, large, expensive, and potentially dangerous to operate.

A variety of relatively simpler exercise equipment is also known, including stationary devices for climbing exercise. However, while having some advantages over Brewer, such devices continue to be fairly complicated, large, expensive, and dangerous to operate to varying degrees. Also, while they offer a general form of cardiovascular workout akin to cycling or rowing, such existing climbing exercisers are generally less adapted to the sport of climbing than Brewer or indoor climbing gyms and are therefor relatively less beneficial to a climbing enthusiast interested in developing the specific muscle groups most helpful for outdoor climbing.

For example, Charnitski (U.S. Pat. No. 5,040,785) discloses a "Climbing Exercise Machine" with hand grips and foot pedals that facilitate coordinated leg and arm movements in a stationary vertical climbing motion. Charnitski fails to accurately simulate the movements of a climber engaged in a natural climb and therefore fails to isolate and efficiently develop the muscle groups of primary benefit to a climber. Charnitski also continues to be fairly complicated, involving many moving parts and components, which can wear out, break, or malfunction overtime.

Furthermore, neither the devices disclosed by Brewer or Charnitski are designed to permit the climber to specifically train on the most demanding overhanging climbing scenarios as these devices are limited to a vertical or less than vertical climbing orientation. That is, in these devices, the climber is orientated such as one would to climb a ladder rather than a natural overhead climbing rock. Even the large indoor climbing gyms, which may more closely replicate an overhanging climbing experience, have the limitation of not isolating specific muscle groups and also do not offer a convenient means for repetitive exercise of these specific muscle groups.

Therefore, there exists a need for an improved strength training apparatus for simulated overhanging climbing that is compact, safe, easy to use, easy to maintain, relatively inexpensive, and which permits a climber to isolate and repeatedly exercise specific muscle groups used for overhanging climbing.

SUMMARY

Disclosed herein are embodiments of overhead climb strength trainer apparatus. The apparatuses may comprise a frame, including a top frame portion, a bottom frame portion, and a plurality of vertical frame portions, including at least one interior vertical frame portion bisecting the frame, forming first and second climbing areas. The apparatus may further comprise a first climbing panel including first climbing holds disposed upon a frontal surface of the first climbing panel and a first panel hook attached to an upper portion of the first climbing panel, wherein the first climbing panel is slideably mounted within the first climbing area.

The apparatus may further include a second climbing panel including second climbing holds disposed upon a frontal surface of the second climbing panel and a second panel hook attached to an upper portion of the second climbing panel, wherein the second climbing panel is slideably mounted within the second climbing area.

The apparatus may further include one or more lines guides. In some embodiments, the apparatus has a first line guide mounted to the top frame portion and a second line guide mounted to the top frame portion. In alternative embodiments, line guides may be mounted on various other portions of the frame to direct the line.

The apparatus may further include a friction cylinder mounted to the frame generally between the first and second line guides, the friction cylinder including at least one circumferential groove. The apparatus may further include a line connected to the first panel hook and running through the first line guide, then around the circumferential groove of the friction cylinder, through the second line guide, and connected to the second panel hook.

In some embodiments, the frame may be configured for mounting at a predetermined angle of inversion for simulating an overhead climb for users to manually raise and lower the first and second climbing panels in a reciprocating fashion within the first and second climbing areas respectively.

In some embodiments, the friction cylinder may include at least one circumferential groove configured to receive the line and permit the line to slide circumferentially against the groove.

In some embodiments, the first and second climbing panels include panel guides configured to releasably mate with the vertical frame portions defining the first and second climbing areas.

In some embodiments, the first and second panels are adapted to permit the first and second climbing holds respectively to be arranged in changeable configurations. In some embodiments, the first and second climbing panels have are adapted to each permit panel hold to be releasably attached with a fastener. The fastener may be a screw, a t-nut, a dowel, or any other suitable fastener known in the art.

In some embodiments, the apparatus may further include first and second lower frame portions each having a proximal end connected to and supporting the bottom frame portion of the frame and each lower frame portion also having distal ends for resting upon a base. In such examples, the apparatus may include first and second lower frame feet connected to the distal end of the first and second lower frame portions respectively, the feet adapted to permit adjustment of the angle of the frame relative to the ground while reducing slippage along the base.

In some embodiments, the top frame portion is adapted to be securely attached to an upper surface.

In some embodiments, the apparatus includes a kick plate attached to and between the lower frame portions is perpendicular to the frame.

In some embodiments, the apparatus includes a hydraulic cylinder. The cylinder may have a proximal end adapted to be rotateably connected to the frame. The cylinder may also have a distal end adapted to be rotateably connected to an external support. The cylinder may be configured to support the frame while permitting adjustment to the predetermined angle of inversion for simulating an overhead climb.

In an alternative embodiment of a free-standing overhead climb strength trainer apparatus, the apparatus may include a frame comprising an upper frame and a lower frame. The upper frame may include a top frame portion, a bottom frame portion, and a plurality of vertical frame portions. The vertical frame portions may include at least one interior vertical frame portion bisecting the upper frame, forming first and second climbing areas. The lower frame may further include first and second lower frame portions. Each lower frame portion may have a proximal end connected to and supporting the bottom frame portion of the upper frame. Each lower frame portion may also have a distal end for resting upon a base. The distal end may have lower frame feet adapted to permit adjustment of the angle of the frame relative to the ground while reducing slippage along the base.

The apparatus may also have first and second support legs. Each support leg may have a proximal end rotateably attached to the frame and a distal end having lower frame feet. The feet may be adapted to permit adjustment of the angle of the frame relative to the ground while reducing slippage along the base.

The apparatus may further include a first support leg brace connected to the first support leg and the frame. The first support leg brace may be configured to permit adjustment of the second support leg brace to accommodate a change in angle of the frame relative to the base.

DETAILED DESCRIPTION

The apparatuses and methods disclosed and described in this document are described in detail with reference to the views and examples of the included figures. Those of ordinary skill in the art will recognize that modifications to disclosed and described components, elements, methods, materials, and so forth can be made and can be predetermined for a specific application.

In this disclosure, any identification of specific shapes, materials, techniques, and the like are either related to a specific example presented or are merely a general description of such a shape, material, technique, or the like. Identifications of specific details are not intended to be and should not be construed as mandatory or limiting unless specifically designated as such. Selected examples and methods of use are disclosed and described in detail below. It should be noted that those having an ordinary level of skill in this area will recognize from reading this disclosure that various components of the disclosed apparatuses can be combined in ways not specifically shown in the examples to create an additional specific configuration. For ease of understanding and readability, no attempt is made to catalog every possible combination of the disclosed components.

FIG. 1 is a frontal view of an overhang climb strength trainer apparatus. The apparatus includes vertical frame portions 110, including an upper frame 114 and a lower frame 115. The upper frame 114 includes a top frame portion 111, a bottom frame portion 112, and interior frame portions 113 forming a first rectangular climbing area 120A and a second rectangular climbing area 120B. In some embodiments, the upper frame 114 may be further supported by braces 117 connected to the lower frame 115. In some embodiments, feet 116 can be used to reduce slippage of the lower frame legs resting upon a lower surface.

The upper frame 114, including its interior frame 113 portions, may be adapted to receive a first panel 121 slidably mounted in the first climbing area 120A and a second panel 122 slidably mounted in the second climbing area 120B. In some embodiments, the panels may include durable panel guides adapted to slide along the upper frame 114, including its interior frame portions 113.

The first panel 121 may further include first panel holds 121.1 in a preferred pattern of panel holds and a first panel hook 153. Likewise, the second panel 122 may further include second panel climbing holds 122.1 in a preferred pattern of panel holds and a second panel hook 154.

The panel holds may be comprised of any desired shape or size. For example, in some embodiments, each panel hold may have a shape that simulates a rock formation. In other embodiments, the panel holds may be of a variety of alternative shapes and sizes.

The panel holds may be releasably attached to the panels using any suitable fastening means known in the art. For example, in one embodiment, the holds may fastened to the panels by drilling holes through the panels at desired locations, affixing t-nuts from the back, and screwing the holds down onto the t-nuts from the front. The panel holds may be interchangeable, enabling the rearrangement or climbing hold patterns on the first and second climbing panels.

The upper frame may further include a first mounted line guide 151, a second mounted line guide 152, and a friction cylinder 130. The mounted line guides may be moveable pulleys, stationary pulleys, or any shape or configuration suitable for receiving a line extending in one direction and guiding it to extend in a second direction.

As depicted, the friction cylinder, mounted line guides, and panel hooks may be adapted to be slideably connected by a line 140 extending from the first panel hook 153, through the first mounted line guide 151, around the friction cylinder 130, through the second mounted line guide 154, and to the second panel hook 154 such that when the first panel 121 is lowered within the first climbing area 120A, the second panel 122 is raised within the second climbing area 120B. Likewise, when the second panel 122 is lowered the first panel 121 is raised.

The friction cylinder 130 may have a smooth surface adapted to permit the line to wrap around its circumference thereby imparting friction as the line slides circumferentially as it is pulled by operation of the apparatus. The friction cylinder 130 may be made of metal, wood, plastic, hard rubber, or any other suitable material. The friction cylinder may also include a circular plate mounted on either or both its distal or proximal ends.

In other embodiments, the friction cylinder by have one or more circumferential grooves adapted for accepting the line and providing a channel to guide the line.

The upper frame 114 may further include a tray (not depicted) along the bottom frame portion 112 adapted to support the first 121 and second 122 panels when the panels are fully lowered a minimum predetermined distance from the lower surface. Optionally, the tray may include a cushioning device, such as rubber stoppers, positioned to be in contact with the panels when fully lowered to the tray.

In some embodiments the line 140 may be rope, a cable, write, a belt, or any other suitable material for facilitating the raising and lowering of the panels in a 'block and tackle' style pulley system. For example, 5 mil. cordelette climbing rope may be used as the line. In some examples, a particular kind and diameter of line may be selected based upon a desired amount of friction.

The frame, panel guides, and panels may be fabricated using wood, metal, plastic, or any other material with suitable strength and durability properties. In one embodiment, the upper frame 114 includes a wood exterior portion with attached interior metal rails along the vertical surfaces in which the panel guides are slideably mounted. In other examples, the frame, rails, and panel guides are metal while the panels are wood.

The panels used in the apparatus may be interchangeable. For example, the first panel 121 and second panel 122 may be removed and replaced with alternative panels.

Figure 2:
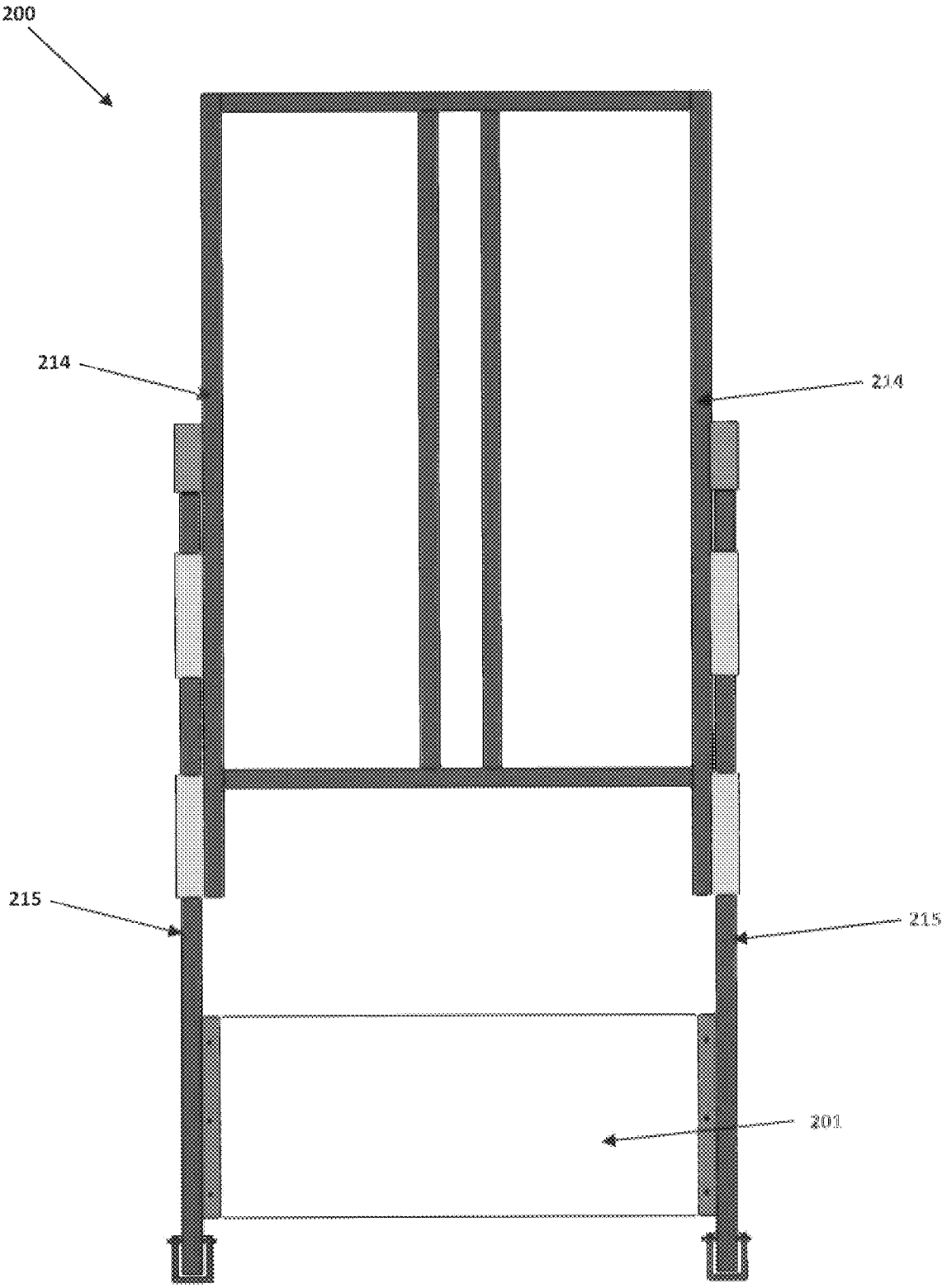
FIG. 2 is a frontal view of an overhang climb strength trainer.

FIG. 2 is a frontal view of an embodiment of an overhang climb strength trainer 200 that includes a lower kick plate 201. In some examples, kick plate 201 is adapted to support the weight of a user of the apparatus. In some examples, the kick plate 201 is positioned in a generally perpendicular orientation relative to the upper frame 214. In some embodiments, the kick plate 201 may be adjustable in terms of its distance from the lower surface or adjustable in terms of its orientation relative to the upper frame.

Figure 3:
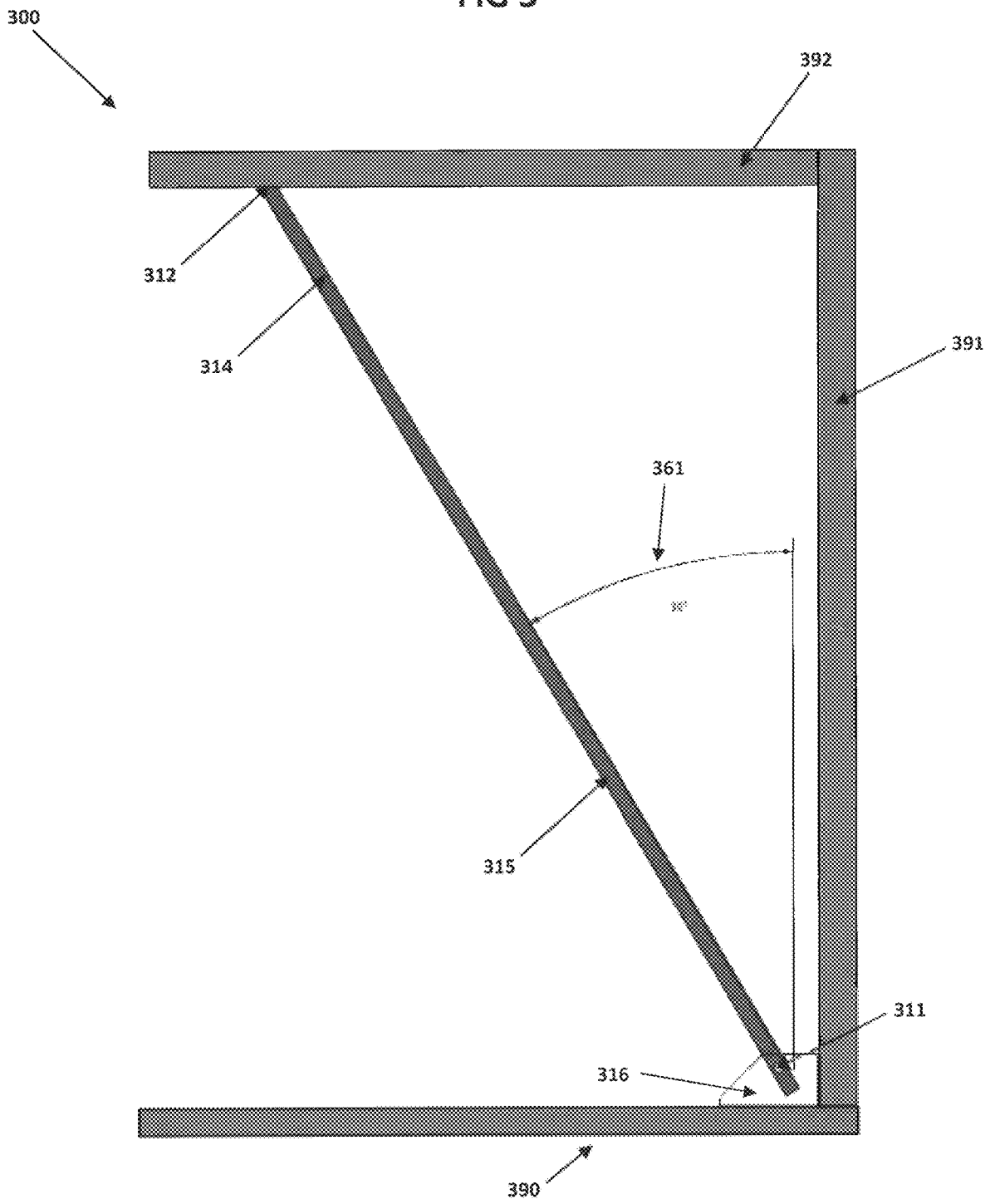
FIG. 3 is a side view of an overhang climb strength trainer.

FIG. 3 is a side view of an overhang climb strength trainer 300 adapted for mounting in a room having a lower surface 390, a vertical surface 391, and an upper surface 392. As shown, the feet 316 could rest upon the lower surface 390 and abut the vertical surface 391. Each side of the overhead climb strength training apparatus 300 may have an upper connection point 312 securely mounted to the upper portion 392 and a lower connection point 311 securely connected to a foot 316. In this way, the apparatus 300 can be mounted such that a predetermined angle 361 for overhead climb can be achieved, such that a user, while operating the apparatus from its front 301 will be orientated in a fashion that simulates an overhang climb, with the apparatus frame's upper portion 314 overhanging the lower portion 315.

Figure 4:
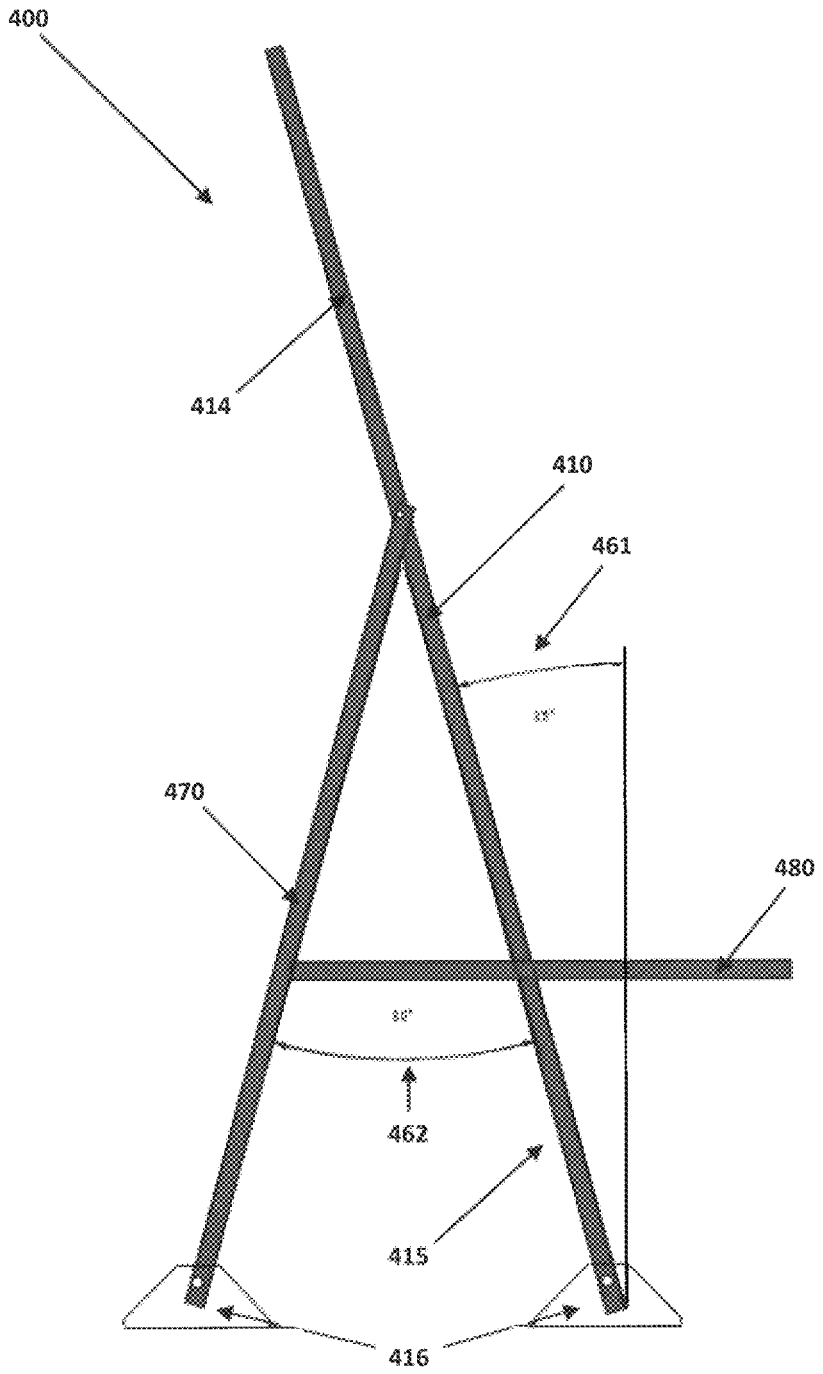
FIG. 4 is a side view of a freestanding overhang climb strength trainer.

FIG. 4 is a side view of a freestanding overhang climb strength trainer apparatus 400. As depicted, the apparatus 400 may include a vertical frame 410 with upper frame portion 414 and lower frame portion 415. The upper frame portion may be adapted to receive slideably mounted panels as in the example of FIG. 1. Each side of the frame 410 may be supported by a support leg 470 and a support leg brace 480, in an A-Frame configuration as shown, with feet 416 configured for receiving the lower portions of the support leg 470 and lower frame 415 whereby the feet 416 rest upon the lower surface (not shown in FIG. 4) and are adapted to resist slippage. The support legs 470, support leg braces 480, and feet 416 can be configured and reconfigured to a predetermined distance of leg/support separation 462 for a predetermined angle of overhang 461.

Figure 5:
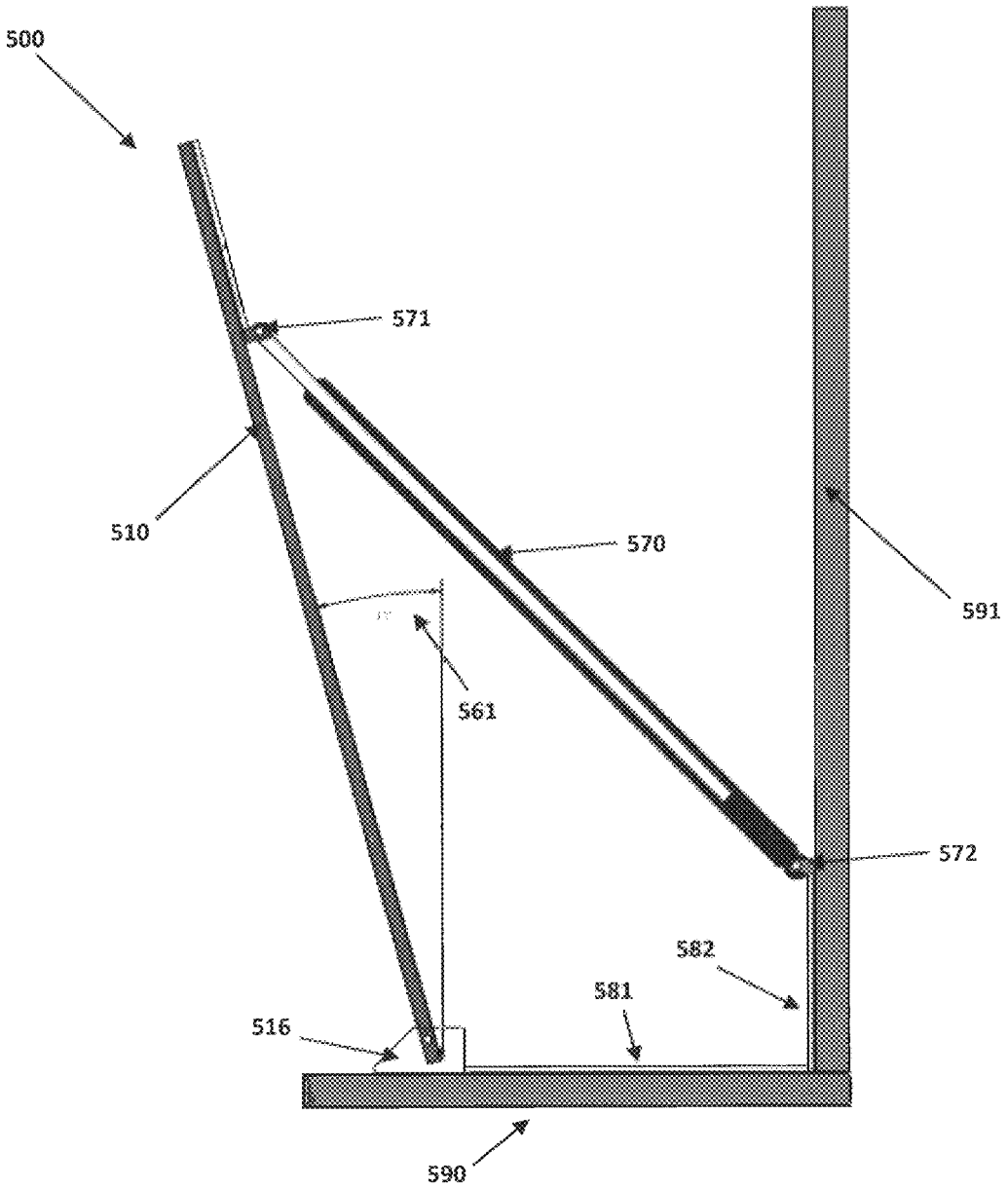
FIG. 5 is a side view of a hydraulic overhang climb strength trainer.

FIG. 5 is a side view of a hydraulic overhang climb strength trainer 500. In this example, a hydraulic cylinder 570 is depicted with attachment point 571 rotateably affixed to the climbing apparatus frame 510. The hydraulic cylinder 570 also has an attachment point 572 rotateably affixed to a vertical surface 591. As further depicted, each side can have a foot 516 configured to receive the lower portion frame 510 whereby the feet 516 rest upon the lower surface 590 and are adapted to resist slippage. Optionally, a horizontal brace 581 can be used to reduce unintended movement of the feet 516. Optionally, a vertical brace 582 can be used to support the hydraulic cylinder 570 at attachment point 572.

Figure 6A:
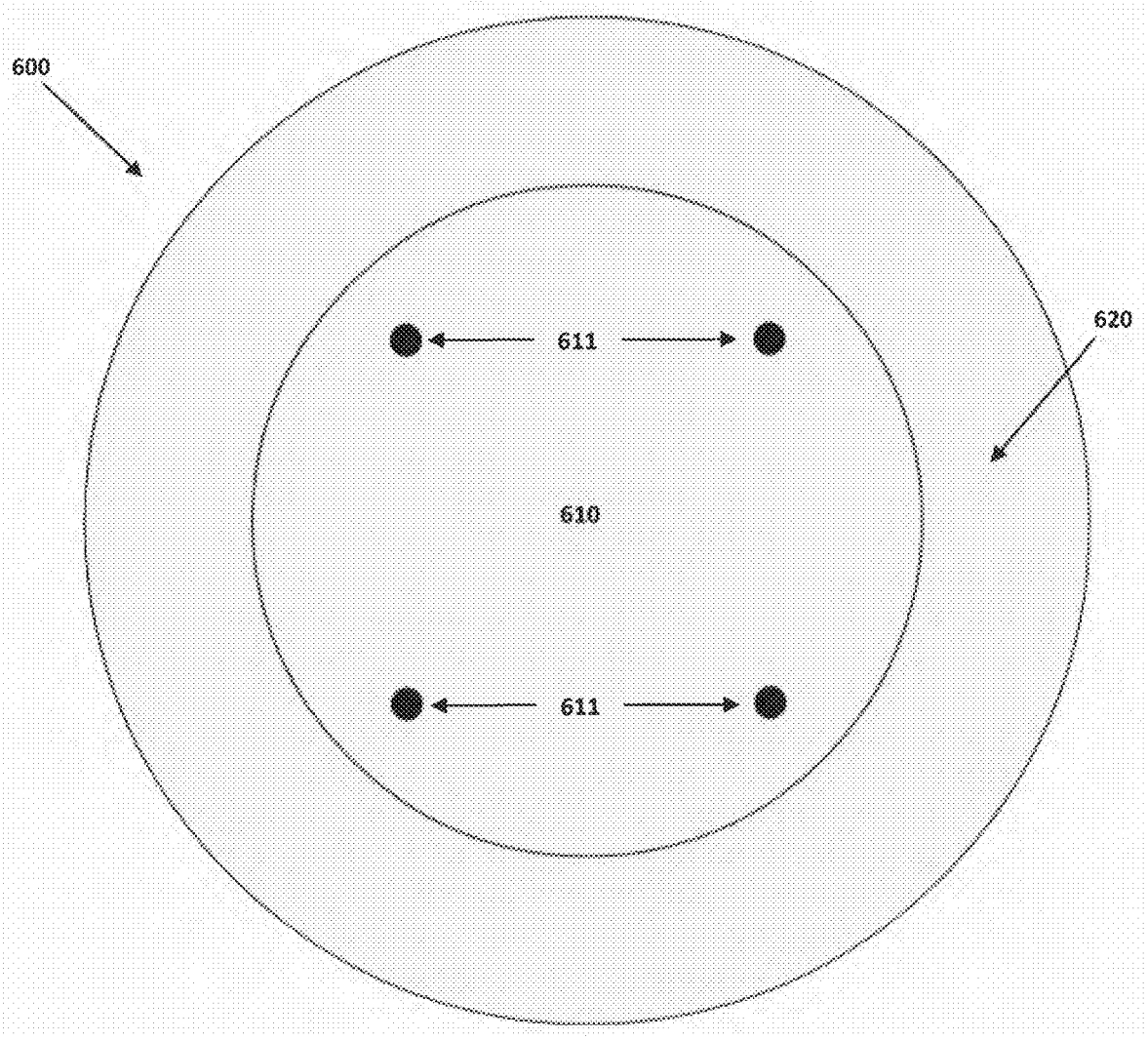
FIG. 6A is a top view of a grooved friction cylinder.
Figure 6B:
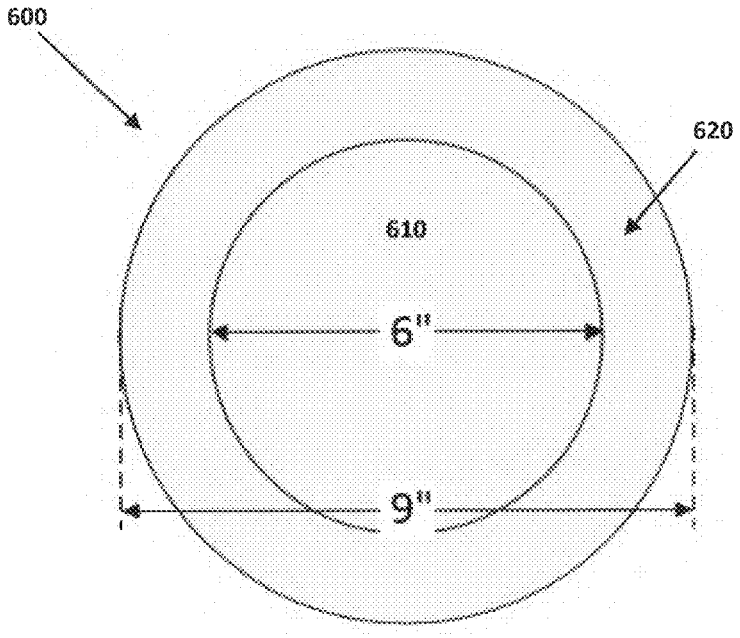
FIG. 6B is a top view of a grooved friction cylinder.
Figure 6C:
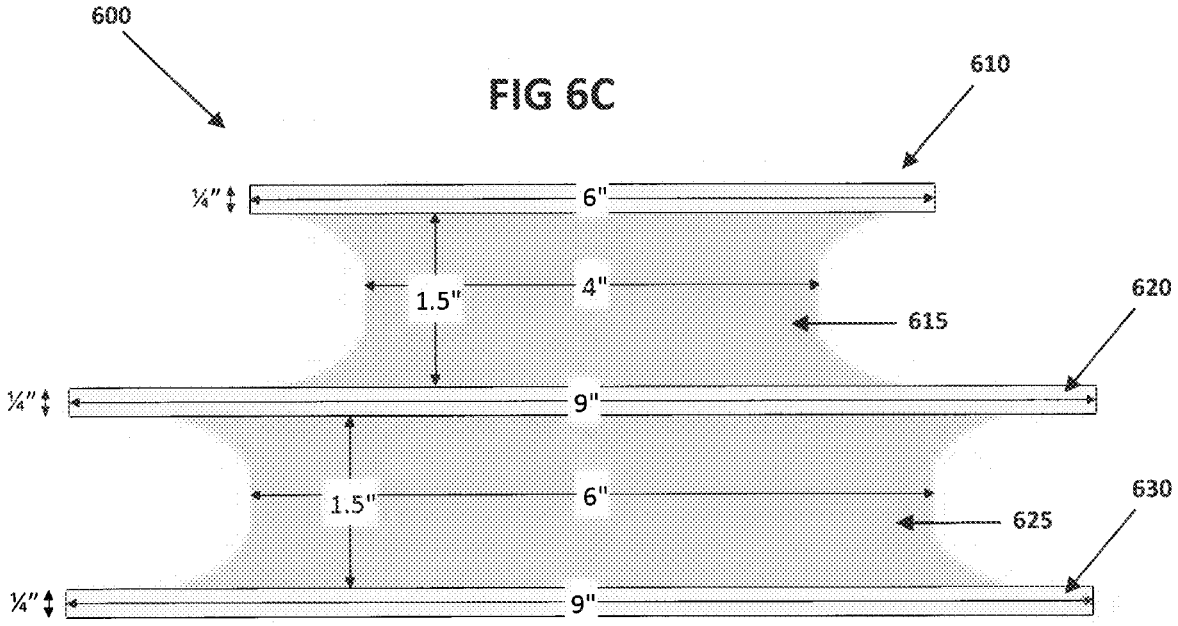
FIG. 6C is a side view of a grooved friction cylinder.

FIGS. 6A, 6B, and 6C depict an example of a grooved friction cylinder for use in connection with the apparatus. As shown in FIG. 6A, the friction cylinder 600 may include mounting holes 611 to facilitate secure attachment to the interior frame portions of the apparatus. As further shown in FIGS. 6A-C, the friction cylinder 600 may include a first head 610, second head 620, and third head 630, forming a first groove 615 and a second groove 625. In some examples, the first head 610 may have a smaller diameter than the second 620 and third 630 heads. The friction cylinder 600 may be adapted to receive a line wrapped around the first groove 615 and second groove 625 in a block and tackle configuration.

Figure 7A:
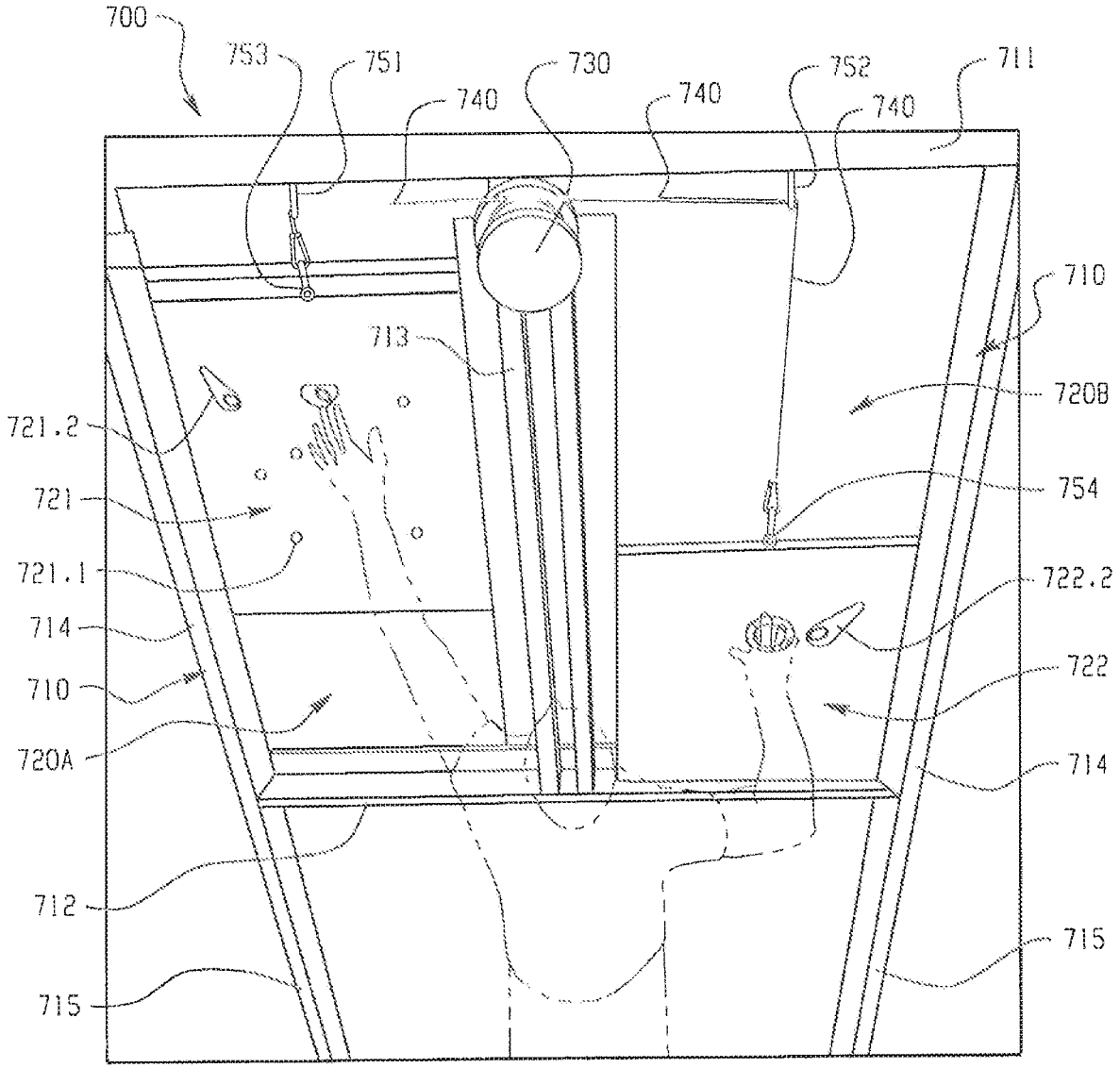
FIG. 7A is a perspective view of an overhang climb strength trainer in operation.

FIG. 7A is a perspective view of an overhang climb strength trainer in operation. As shown, the apparatus 700 includes vertical frame portions 710, including an upper frame 714 and a lower frame 715. The upper frame 714 includes a top frame portion 711, bottom frame portion 712, and interior frame portions 713 forming a first climbing area 720A and a second climbing area 720B.

The upper frame 714, including its interior frame 713 portions, may be adapted to receive a first panel 721 slidably mounted in the first climbing area 720A and a second panel 722 slidably mounted in the second climbing area 720B. In some embodiments, the panels may be include durable panel guides adapted to slide along the upper frame 714, including its interior frame portions 713.

The first panel 721 may further include first panel holes 721.1 for receiving and releasably attaching first panel holds 721.2 in a preferred pattern of panel holds. The first panel 721 is also depicted with a first panel hook 753. Likewise, the second panel 722 may further include second panel holes (not shown), second panel climbing holds 722.2 and a second panel hook 754.

The upper frame may further include a first mounted line guide 751, a second mounted line guide 752, and a friction cylinder 730. As depicted, the friction cylinder 730, mounted line guides 751 and 752, and panel hooks 753 and 754 may be adapted to be slideably connected by a line 740 extending from the first panel hook 753, through the first mounted line guide 751, around the friction cylinder 740, through the second mounted line guide 752, and to the second panel hook 754 such that when the first panel 721 is lowered, the second panel 722 is raised and when the second panel 722 is lowered the first panel 721 is raised.

The upper frame 714 may further include a tray along the bottom frame portion 712 adapted to support the first 721 and second 722 panels when the panels are fully lowered a minimum predetermined distance from the lower surface. Optionally, the tray may include a cushioning device, such as rubber stoppers, positioned to be in contact with the panels when fully lowered to the tray.

Figure 7B:
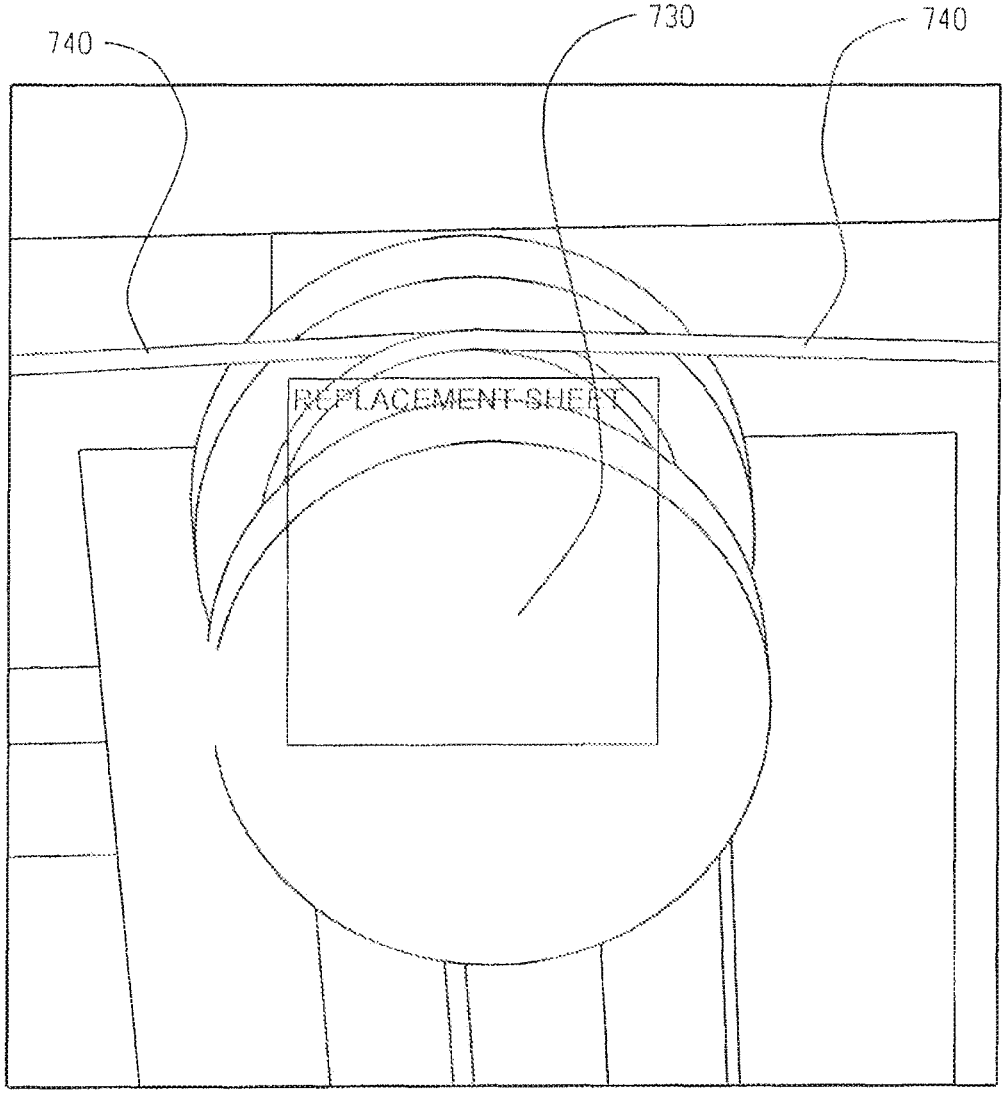
FIG. 7B is a perspective view of a grooved friction cylinder.
Figure 7C:
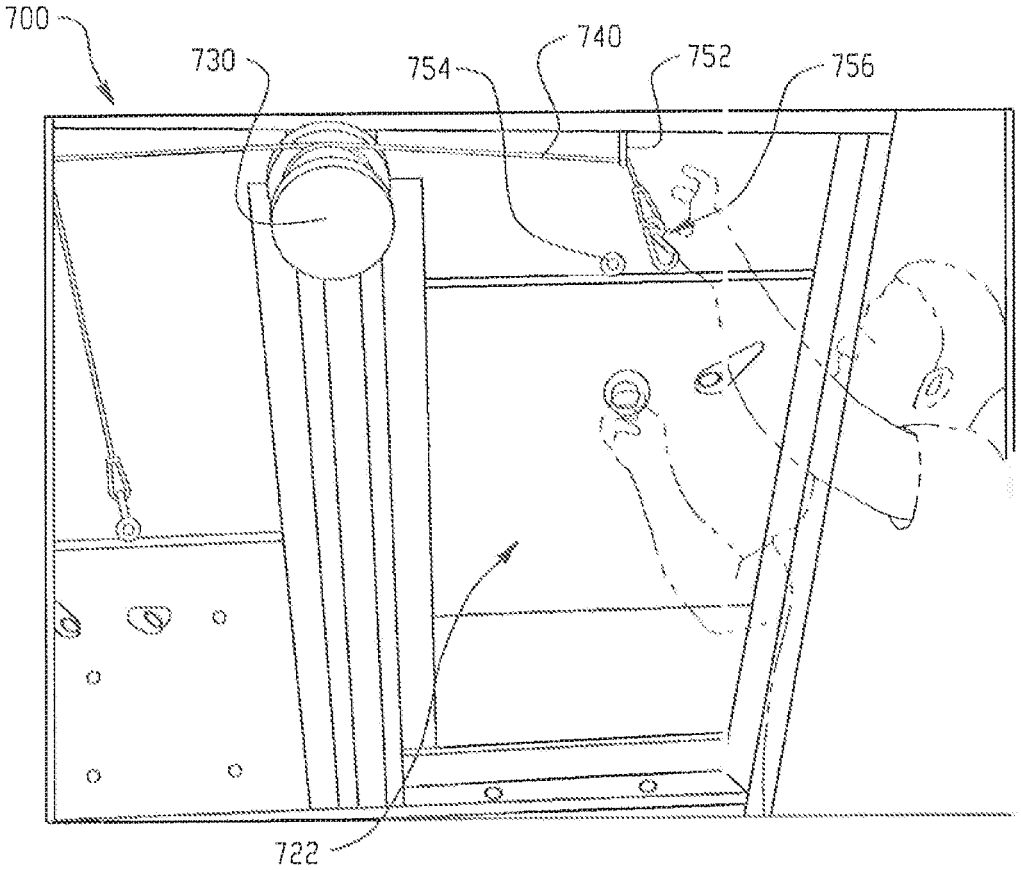
FIG. 7C is a perspective view of a step in the process of changing a panel of an overhang climb strength trainer.

FIG. 7B is a perspective view of a grooved friction cylinder 730 and line 740 as used in operation of the apparatus of FIG. 7A.

FIGS. 7C-F depict a method of changing a panel of the overhang climb strength trainer depicted in FIG. 7A. As shown in the step depicted by FIG. 7C, the user unhooks a second attachment device 756, which can include a carabiner or other suitable device, from the second panel hook 754. The attachment device remains securely attached to the line 740, which runs through the second mounted line guide 752 and around the friction cylinder 730.

Figure 7D:
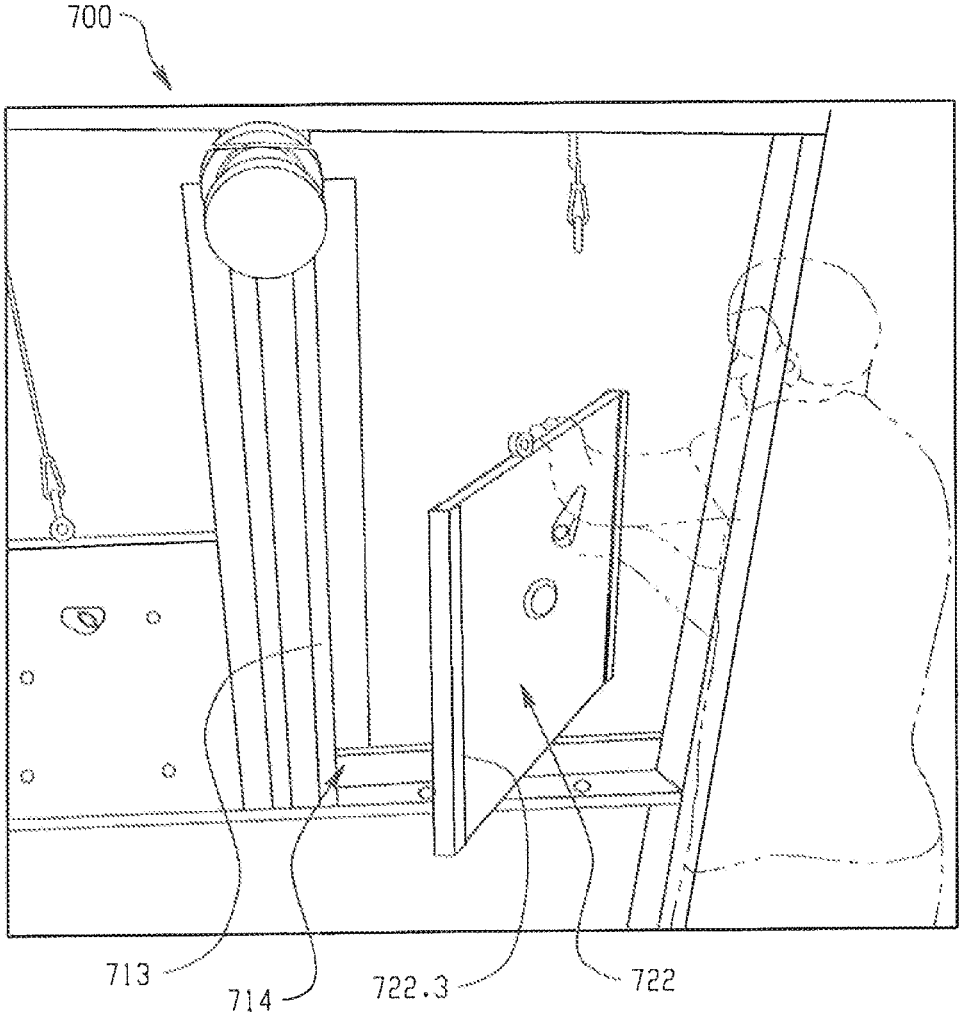
FIG. 7D is a perspective view of a step in the process of changing a panel of an overhang climb strength trainer.

As shown in FIG. 7D, the user next removes the second panel 722 from the apparatus 700 by pushing it out of contact with the upper frame 714, including the interior portions 713, and rotating the second panel 722. As shown in FIG. 7D, the second panel 722 has metal panel guides 722.3.

Figure 7E:
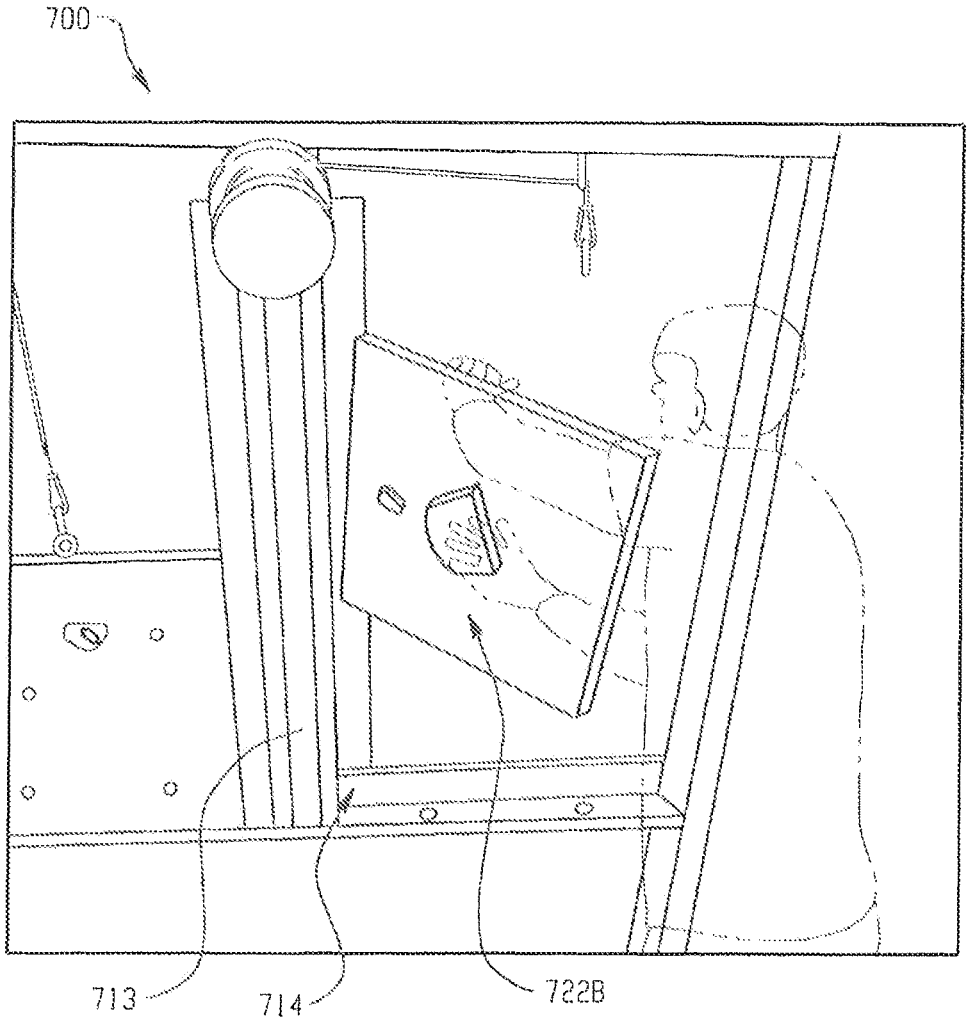
FIG. 7E is a perspective view of a step in the process of changing a panel of an overhang climb strength trainer.

In FIG. 7E, the panel is shown in the process of being replaced with a new second panel 722B. This step essentially entails the reverse of the step depicted in FIG. 7D, whereby the new second panel 722B is inserted sideways through the second climbing area and then rotated such that it will be slideably mounted on the upper frame 714, including its interior portions 713.

Figure 7F:
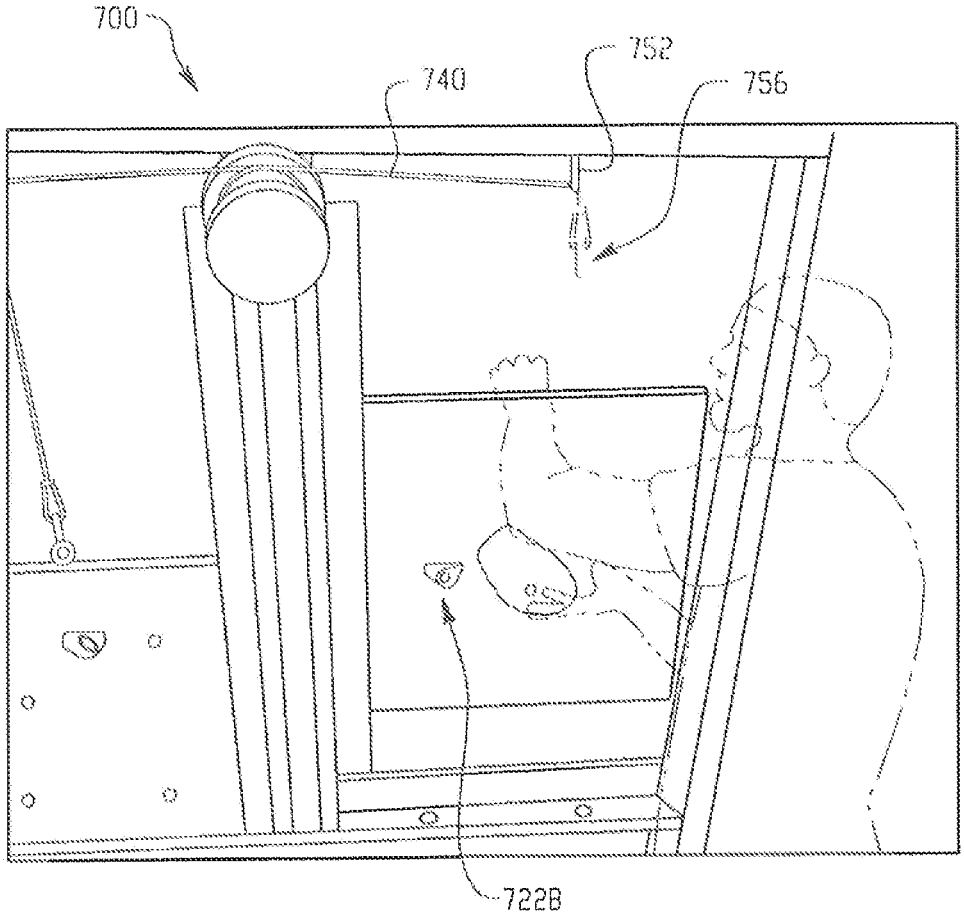
FIG. 7F is a perspective view of a step in the process of changing a panel of an overhang climb strength trainer.

In FIG. 7F, new second panel 722B has been slideably mounted on the upper frame 714, including its interior portions 713. The new second panel 722B is then raised by the user and the second attachment device 756 is attached to the new panel attachment hook.

Figure 8:
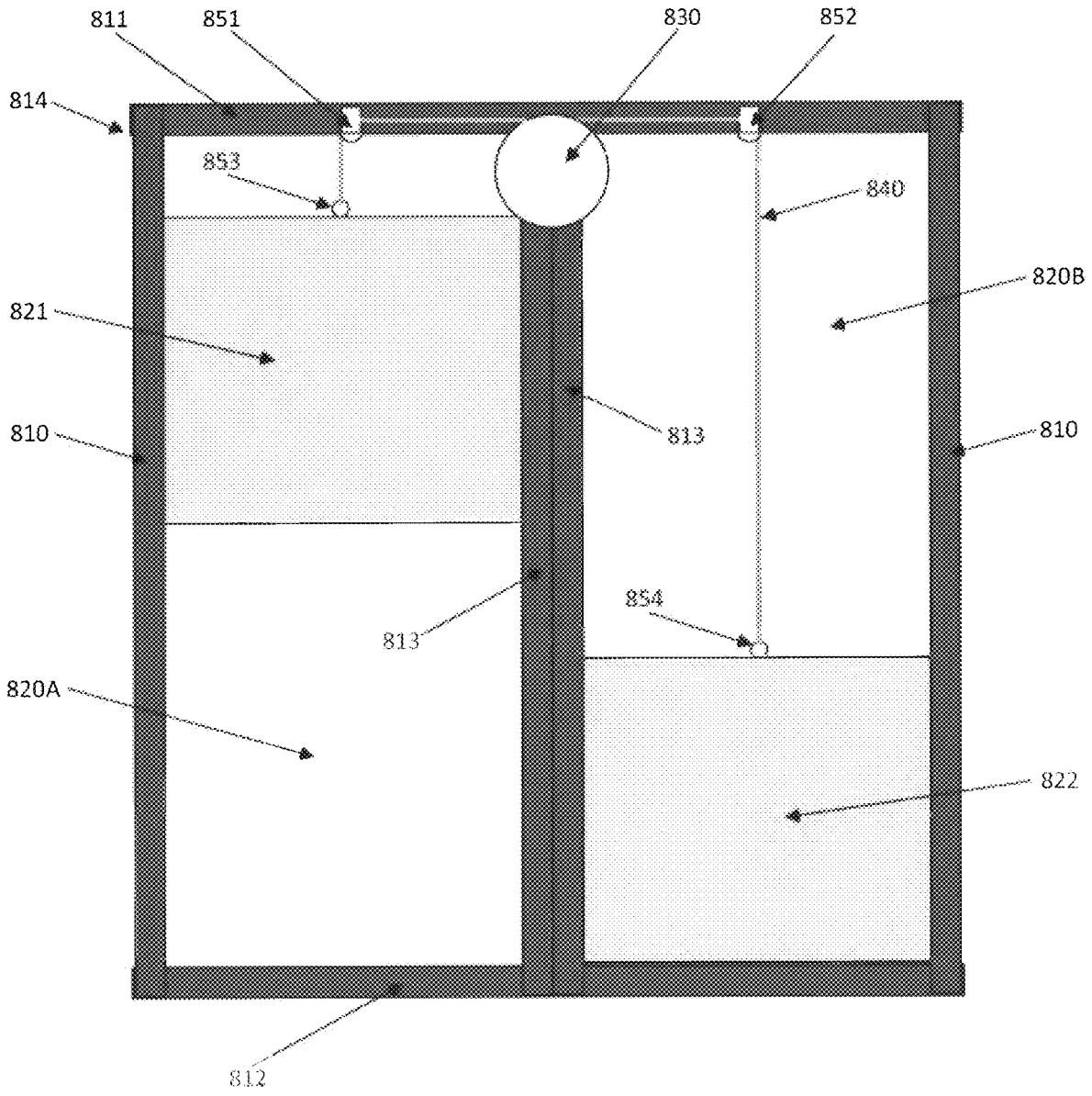
FIG. 8 is a frontal view of an overhang climb strength trainer

FIG. 8 is a frontal view of an overhang climb strength trainer apparatus. The frame 814 includes a top frame portion 811, a bottom frame portion 812, exterior vertical frame portions 810 and interior vertical frame portions 813 forming a first rectangular climbing area 820A and a second rectangular climbing area 820B. The top frame portion 811 and bottom frame portion 812 may be equipped to mount on various structures.

The vertical frame 810, including its interior vertical frame 813 portions, may be adapted to receive a first panel 821 slidably mounted in the first climbing area and a second panel 822 slidably mounted in the second climbing area 820B. In some embodiments, the panels may include durable panel guides adapted to slide along the upper frame 814, including its interior frame portions 813.

The first panel 821 may further include first panel holds in a preferred pattern of panel holds (holds not shown in FIG. 8) and a first panel hook 853. Likewise, the second panel 822 may further include second panel climbing holds and a second panel hook. The second panel 822 may further include second panel holds in a preferred pattern of panel holds (holds not shown in FIG. 8) and a second panel hook 854.

The upper frame may further include a first mounted line guide 851, a second mounted line guide 852, and a friction cylinder 830. As depicted, the friction cylinder, mounted line guides, and panel hooks may be adapted to be slideably connected by a line 840 extending from the first panel hook 853, through the first mounted line guide 851, around the friction cylinder 830, through the second mounted line guide 854, and to the second panel hook 854 such that when the first panel 821 is lowered within the first climbing area 820A, the second panel 822 is raised within the second climbing area 820B. Likewise, when the second panel 822 is lowered the first panel 821 is raised.

The frame 814 may further include a tray (not depicted) along the bottom frame portion 812 adapted to support the first 821 and second 822 panels when the panels are fully lowered a minimum predetermined distance from the lower surface. Optionally, the tray may include a cushioning device, such as rubber stoppers, positioned to be in contact with the panels when fully lowered to the tray.

In some embodiments the line 840 may be rope, a cable, write, a belt, or any other suitable material for facilitating the raising and lowering of the panels in a 'block and tackle' style pulley system. For example, 5 mil. cordelette climbing rope may be used as the line. In some examples, a particular kind and diameter of line may be selected based upon a desired amount of friction.

The frame, panel guides, and panels may be fabricated using wood, metal, plastic, or any other material with suitable strength and durability properties. In one embodiment, the frame 814 includes a wood exterior portion with attached interior metal rails along the vertical surfaces in which the panel guides are slideably mounted. In other examples, the frame, rails, and panel guides are metal while the panels are wood.

The panels used in the apparatus may be interchangeable. For example, the first panel 821 and second panel 822 may be removed and replaced with alternative panels.

In some embodiments, the apparatus described in FIG. 8 may be adapted for mounting on a surface. For example, the frame 814 may include holes on its outer four corners for inserting a fastening means such as lag bolts. The bolts or other fastening means known in the art can attach the frame to a surface, such as, for example, an existing climbing wall. In some examples, the surface may be an overhead climbing wall. In other examples, the surface be a vertical wall.

In other examples, the frame 814 may be adapted for mounting in conjunction with a movable surface. For example, the frame 814 may be mounted to a substrate that is in-turn attached to a fixed surface using one or more hinges or other means known in the art to permit the substrate to swivel up, down, left, right, and in or out, in a desired orientation.

What is claimed is:

1. An overhead climb strength trainer apparatus, comprising a frame, including a top frame portion, a bottom frame portion, and a plurality of vertical frame portions, including at least one interior vertical frame portion bisecting the frame, forming first and second climbing areas;

a first climbing panel including first climbing holds disposed upon a frontal surface of the first climbing panel and a first panel hook attached to an upper portion of the first climbing panel, wherein the first climbing panel is slideably mounted within the first climbing area;

a second climbing panel including second climbing holds disposed upon a frontal surface of the second climbing panel and a second panel hook attached to an upper portion of the second climbing panel, wherein the second climbing panel is slideably mounted within the second climbing area;

a first line guide mounted to the top frame portion;

a second line guide mounted to the top frame portion;

a friction cylinder mounted to the frame between the first and second line guides;

a line connected to the first panel hook and running through the first line guide, around the friction cylinder, through the second line guide, and connected to the second panel hook; and wherein the frame is configured for mounting at a predetermined angle of inversion for simulating an overhead climb as users manually raise and lower the first and second climbing panels in a reciprocating fashion within the first and second climbing areas respectively.

2. The apparatus of claim 1 wherein the friction cylinder includes at least one circumferential groove configured to receive the line and permit the line to slide circumferentially against the groove.

3. The apparatus of claim 2 wherein the first and second climbing panels are interchangeable.

4. The apparatus of claim 3 wherein the first and second climbing panels include panel guides configured to releasably mate with the plurality of vertically frame portions defining the first and second climbing areas.

5. The apparatus of claim 4 wherein the first and second panels are adapted to permit the first and second climbing holds respectively to be arranged in changeable configurations.

6. The apparatus of claim 5 wherein the first and second climbing panels have are adapted to each permit panel hold to be releasably attached with a fastener.

7. The apparatus of claim 6 further comprising first and second lower frame portions each having a proximal end connected to and supporting the bottom frame portion of the frame and each lower frame portion also having distal ends for resting upon a base.

8. The apparatus of claim 7 further comprising first and second lower frame feet connected to the distal end of the first and second lower frame portions respectively, the first and second lower frame feet adapted to permit adjustment of the angle of the frame relative to the ground while reducing slippage along the base.

9. The apparatus of claim 8 wherein the top frame portion is adapted to be securely attached to an upper surface.

10. The apparatus of claim 9 further comprising a kick plate attached to and between the lower frame portions in a perpendicular orientation relative to the frame.

11. The apparatus of claim 8 further comprising a hydraulic cylinder, the hydraulic cylinder including a proximal end adopted to be rotateably connected to the frame, including a distal end, adapted to be rotateably connected to an external support, wherein the hydraulic cylinder is configured to support the frame while permitting adjustment to a predetermined angle of inversion for simulating an overhead climb.

12. A free-standing overhead climb strength trainer apparatus, comprising a frame comprising an upper frame and a lower frame, the upper frame including a top frame portion, a bottom frame portion, and a plurality of vertical frame portions, including at least one interior vertical frame portion bisecting the upper frame, forming first and second climbing areas; the lower frame including first and second lower frame portions, each having a proximal end connected to and supporting the bottom frame portion of the upper frame and each lower frame portion also having distal ends for resting upon a base, each distal end having lower frame feet, the lower frame feet adapted to permit adjustment of the angle of the frame relative to the ground while reducing slippage along the base;

first and second support legs, each of the first and second support legs having a proximal end rotateably attached to the frame and a distal end having lower frame feet, the lower frame feet adapted to permit adjustment of the angle of the frame relative to the ground while reducing slippage along the base;

a first support leg brace connected to the first support leg and the frame, the first support leg brace configured to permit adjustment of the second support leg brace to accommodate a change in angle of the frame relative to the base;

a second leg brace connected to the second support leg and the frame, the second support leg brace configured to permit adjustment of the second support leg brace to accommodate a change in angle of the frame relative to the base;

a first climbing panel including first climbing holds disposed upon a frontal surface of the first climbing panel and a first panel hook attached to an upper portion of the first climbing panel, wherein the first climbing panel is slideably mounted within the first climbing area;

a second climbing panel including second climbing holds disposed upon a frontal surface of the second climbing panel and a second panel hook attached to an upper portion of the second climbing panel, wherein the second climbing panel is slideably mounted within the second climbing area;

a first line guide mounted to the upper frame portion above the first panel hook;

a second line guide mounted to the upper frame portion above the second panel hook;

a friction cylinder mounted to the frame between the first and second line guide; and a line connected to the first panel hook and running through the first line guide, around the friction cylinder, through the second line guide, and connected to the second panel hook.

13. The apparatus of claim 12 wherein the friction cylinder includes at least one circumferential groove configured to receive the line and permit the line to slide circumferentially against the groove.

14. The apparatus of claim 13 wherein the first and second climbing panels are interchangeable.

15. The apparatus of claim 14 wherein the first and second climbing panels include panel guides configured to releasably mate with the vertical frame portions defining the first and second climbing areas.

16. The apparatus of claim 15 wherein the first and second panels are adapted to permit the first and second climbing holds respectively to be arranged in changeable configurations.

17. The apparatus of claim 16 wherein the first and second climbing panels have are adapted to each permit panel hold to be releasably attached with a fastener.

* * * * *